US009101230B2

(12) United States Patent
Sosso et al.

(10) Patent No.: US 9,101,230 B2
(45) Date of Patent: Aug. 11, 2015

(54) SALAD PUSHER

(71) Applicant: The Marco Company, Fort Worth, TX (US)

(72) Inventors: Jerome F. Sosso, Forth Worth, TX (US); Craig Alan Nickell, Fort Worth, TX (US)

(73) Assignee: THE MARCO COMPANY, Ft. Worth, TX (US)

( * ) Notice: Subject to any disclaimer, the term of this patent is extended or adjusted under 35 U.S.C. 154(b) by 16 days.

(21) Appl. No.: 13/874,239

(22) Filed: Apr. 30, 2013

(65) Prior Publication Data

US 2014/0319086 A1 Oct. 30, 2014

(51) Int. Cl.
*A47F 1/12* (2006.01)

(52) U.S. Cl.
CPC ..... *A47F 1/126* (2013.01); *A47F 1/121* (2013.01); *Y10T 29/49826* (2015.01)

(58) Field of Classification Search
CPC ..... A47F 1/12; A47F 1/121; A47F 1/125; A47F 1/26; A47F 1/128; A47F 7/0014
USPC ..... 211/59.2, 59.3, 51, 88.02, 88.01, 211/126.15, 126.16, 126.5, 132.1, 133.3; 312/60, 61, 71, 72, 73; 221/226, 279, 221/304
See application file for complete search history.

(56) References Cited

U.S. PATENT DOCUMENTS 1,290,512 A * 1/1919 Coleman ..... 211/51
2,139,520 A * 12/1938 Scheinman et al. ..... 312/261
2,625,162 A * 1/1953 Edeborg ..... 211/51
3,161,295 A * 12/1964 Chesley ..... 211/59.3
3,452,899 A * 7/1969 Libberton ..... 221/242
3,780,873 A * 12/1973 Silva ..... 211/59.3
4,907,707 A 3/1990 Crum
5,012,936 A 5/1991 Crum
5,069,349 A 12/1991 Wear et al.
5,088,607 A * 2/1992 Risafi et al. ..... 211/59.3
5,123,546 A 6/1992 Crum
5,240,125 A 8/1993 Kunz
5,366,099 A * 11/1994 Schmid ..... 211/59.3
5,665,304 A * 9/1997 Heinen et al. ..... 312/71
5,673,801 A * 10/1997 Markson ..... 211/59.3
5,749,478 A * 5/1998 Ellis ..... 211/59.2
5,855,283 A * 1/1999 Johnson ..... 211/59.3
6,142,317 A 11/2000 Merl
6,164,462 A * 12/2000 Mumford ..... 211/59.2
6,382,431 B1 5/2002 Burke
6,464,089 B1 10/2002 Rankin, VI
6,691,894 B2 2/2004 Chrisman et al.
6,772,888 B2 8/2004 Burke
6,843,382 B2 * 1/2005 Kanouchi et al. ..... 211/90.02
6,866,155 B2 3/2005 Nagel
6,964,344 B1 * 11/2005 Kim ..... 211/74
7,458,473 B1 * 12/2008 Mason ..... 211/59.3

(Continued)

FOREIGN PATENT DOCUMENTS

EP 0083260 A1 * 7/1983
FR 2542591 A1 * 9/1984
WO WO 0113769 A1 * 3/2001

*Primary Examiner* — Stanton L Krycinski
(74) *Attorney, Agent, or Firm* — Yee & Associates, P.C.

(57) ABSTRACT

A pusher tray assembly comprises a hanging tray and a sliding tray having a wire track, the sliding tray moveably connected to the hanging tray by fins of a pusher, the pusher slidingly engaged to the wire track for movement between a first position and a second position.

16 Claims, 13 Drawing Sheets

(56) References Cited

U.S. PATENT DOCUMENTS

| | | | | |
|---|---|---|---|---|
| 7,681,744 | B2 * | 3/2010 | Johnson | 211/59.3 |
| 7,690,519 | B2 * | 4/2010 | Kahl et al. | 211/59.2 |
| 7,703,614 | B2 * | 4/2010 | Schneider et al. | 211/59.3 |
| 7,918,353 | B1 | 4/2011 | Luberto | |
| 8,096,427 | B2 | 1/2012 | Hardy | |
| 8,186,520 | B2 | 5/2012 | Schneider et al. | |
| 8,210,367 | B2 | 7/2012 | Nagel et al. | |
| 8,302,784 | B2 | 11/2012 | Nagel et al. | |
| 8,342,340 | B2 | 1/2013 | Rataiczak, III et al. | |
| 8,386,075 | B2 | 2/2013 | Lockwood et al. | |
| 8,453,851 | B2 * | 6/2013 | Ciesick | 211/59.3 |
| 8,561,818 | B2 * | 10/2013 | Nagel et al. | 211/59.3 |
| 8,720,702 | B2 * | 5/2014 | Nagel | 211/59.3 |
| 8,820,545 | B2 * | 9/2014 | Kologe | 211/59.3 |
| 2002/0148794 | A1 | 10/2002 | Marihugh | |
| 2003/0136750 | A1 * | 7/2003 | Fujii et al. | 211/90.02 |
| 2005/0199563 | A1 * | 9/2005 | Richter et al. | 211/59.3 |
| 2006/0163272 | A1 | 7/2006 | Gamble | |
| 2006/0186065 | A1 * | 8/2006 | Ciesick | 211/59.3 |
| 2007/0170127 | A1 * | 7/2007 | Johnson | 211/59.3 |
| 2007/0175839 | A1 * | 8/2007 | Schneider et al. | 211/59.3 |
| 2009/0039040 | A1 * | 2/2009 | Johnson et al. | 211/120 |
| 2009/0277853 | A1 | 11/2009 | Bauer | |
| 2010/0107670 | A1 * | 5/2010 | Kottke et al. | 62/250 |
| 2010/0108624 | A1 * | 5/2010 | Sparkowski | 211/59.3 |
| 2010/0140197 | A1 * | 6/2010 | Schneider et al. | 211/59.3 |
| 2010/0176075 | A1 * | 7/2010 | Nagel et al. | 211/59.3 |
| 2010/0176077 | A1 * | 7/2010 | Nagel et al. | 211/126.16 |
| 2010/0199696 | A1 * | 8/2010 | Nagel et al. | 62/255 |
| 2011/0017684 | A1 * | 1/2011 | Nagel et al. | 211/59.3 |
| 2011/0210086 | A1 * | 9/2011 | Ciesick | 211/59.3 |
| 2012/0211450 | A1 | 8/2012 | Kologe | |
| 2012/0234779 | A1 * | 9/2012 | Schneider et al. | 211/59.3 |
| 2012/0255924 | A1 | 10/2012 | Kologe | |
| 2013/0031815 | A1 | 2/2013 | Hardy | |
| 2013/0112634 | A1 * | 5/2013 | Nagel | 211/59.3 |
| 2014/0167962 | A1 * | 6/2014 | Valiulis et al. | 340/568.8 |

* cited by examiner

SALAD PUSHER

BACKGROUND INFORMATION

1. Field

The present disclosure relates generally to product display, and in particular to product display shelves having a spring driven pusher to force product to the front of the display.

2. Background

In retail stores, shelves are necessary for displaying and storing products. When a product is removed from a tray, a gap remains on the tray where the product was stored. Trays that automatically push the product forward are desirable so that a customer is always presented with a product and therefore, does not assume that the product is out of stock, or alternatively have to search for the product.

A number of different types of devices are known for automatically pushing product forward. For example, gravity fed rollers allow certain products to advance so that a product is always present at the front of the display. Another example is a spring driven pusher plate where the spring driven plate advances toward the front of the display as product positioned between the pusher plate and the front of the display is removed.

Although spring driven pusher plates are known, a number of problems arise in the implementation of current spring driven pusher plates. One problem is that springs may break or lose their force and need to be replaced. Replacement of springs may require disassembly of a tray unit in which the pusher plate operates. Another problem with spring driven pusher plates is that the pusher plate must be held to the rear while placing product between the pusher plate and the front of the display. Furthermore, packaged food products may require refrigeration. Cold air sinks to the bottom of a space. Therefore, refrigeration of a display area may be impaired during loading of the trays as removed trays allow cold air to settle to the bottom of the display. Additionally, trays may need to be adjustable to accept products of different widths, and adjusting a tray may cause gaps in levels of the product display that impair refrigeration.

Accordingly, it would be advantageous to have a method and apparatus, which takes into account one or more of the issues discussed above as well as possibly other issues.

SUMMARY

In one illustrative embodiment, a pusher tray assembly comprises a hanging tray and a sliding tray having a wire track, the sliding tray moveably connected to the hanging tray by fins of a pusher, the pusher slidingly engaged to the wire track for movement between a first position and a second position.

In another illustrative embodiment, a pusher tray assembly comprises a hanging tray, a wire track in a sliding tray, the wire track having a plurality of wires, each wire having a first end removably engaged to a front end of the sliding tray and a second end removably engaged to a rear end of the sliding tray. A pusher slidingly engages the sliding tray and the hanging tray for movement between a rear of the sliding tray and a front of the sliding tray and for sliding engagement of the sliding tray to the hanging tray. A left hook extends from a bottom of the pusher and slidingly engages a first wire in the wire track. A right hook extends from the bottom of the pusher and slidingly engages a second wire in the wire track. A left fin extending downward from a bottom of the pusher slidingly engages a center tray track in the hanging tray. A right fin extending downward from the bottom of the pusher slidingly engages the center tray track in the hanging tray. A front plate removably engaged to the front end of the sliding tray secures first ends of wires to the sliding tray. An end cap removably engaged to the rear end of the sliding tray secures second ends of wires to the sliding tray.

In another illustrative embodiment, a method of constructing a pusher tray assembly comprises securing a sliding try to a hanging tray by engaging hooks on a pusher with wires on the sliding tray and by slidingly engaging fins on the pusher with a center track on the hanging tray so that flanges on the fins prevent separation of the sliding tray from the hanging tray.

BRIEF DESCRIPTION OF THE DRAWINGS

The novel features believed characteristic of the illustrative embodiments are set forth in the appended claims. The illustrative embodiments, however, as well as a preferred mode of use, further objectives and advantages thereof, will best be understood by reference to the following detailed description of an illustrative embodiment of the present disclosure when read in conjunction with the accompanying drawings, wherein:

DETAILED DESCRIPTION

In an advantageous embodiment, a pusher tray assembly is configured to allow replacement of a spring without a need to disassemble any or all of the pusher tray assembly.

In an advantageous embodiment, a pusher tray assembly is configured to hold a pusher plate to the rear while placing product between the pusher plate and the front of a display.

In an advantageous embodiment, a pusher tray assembly is configured to be adjustable to a number of widths to accept product of varying widths.

In an advantageous embodiment, a pusher tray assembly is configured with baffles that may be adjusted to prevent downward migration of cold air between pusher trays when a number of pusher tray assemblies are installed in a product display.

A number, as used herein with reference to an item, means one or more items.

Figure 1:
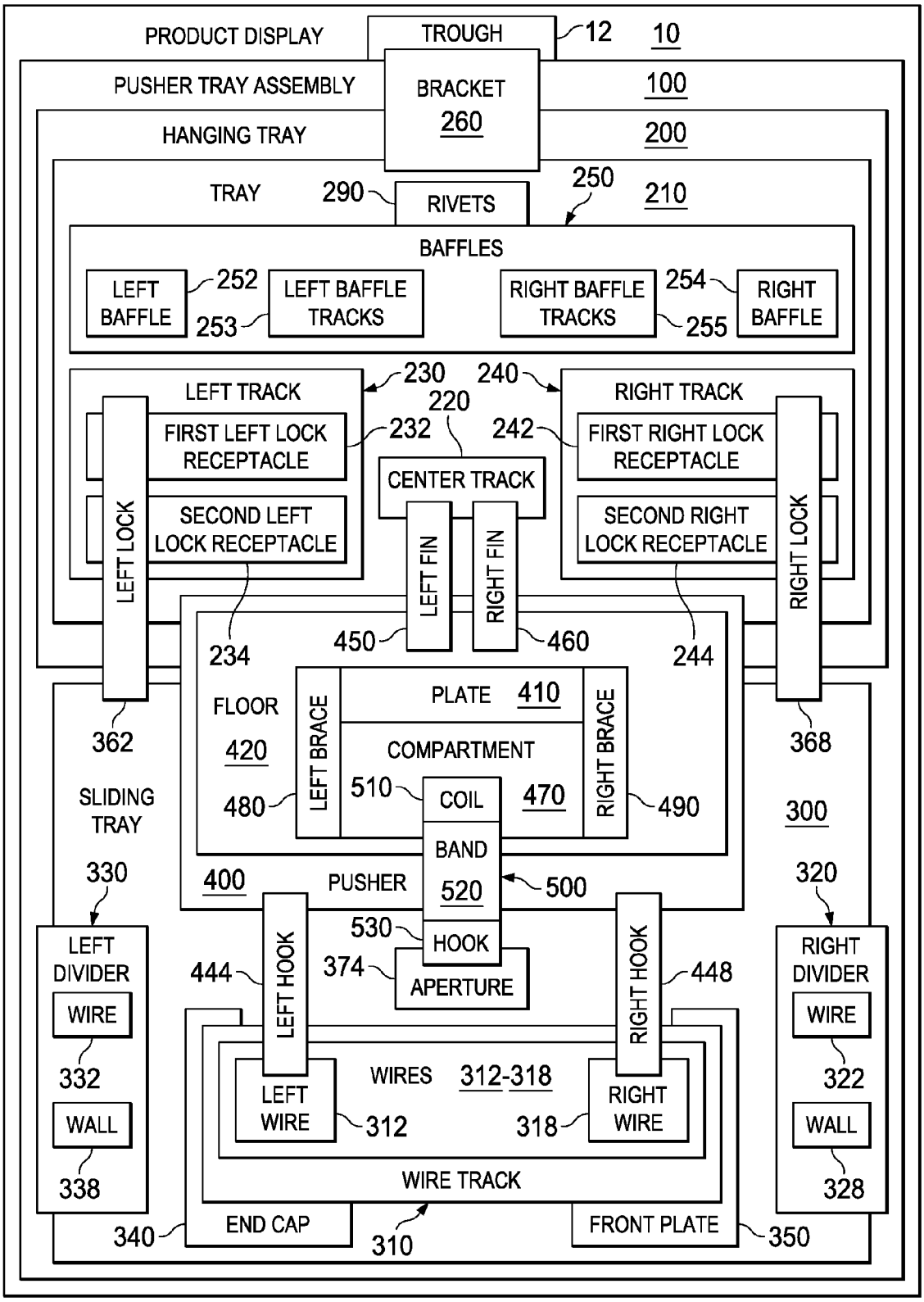
FIG. 1 is an illustration of a block diagram of a pusher tray assembly in accordance with an illustrative embodiment.

FIG. 1 is an illustration of a block diagram of a pusher tray assembly in accordance with an illustrative embodiment. Product display 10 may be an area in which products are displayed for sale. In one embodiment, product display 10 may be product display 10 in FIG. 2. Pusher tray assembly 100 may be configured to convey products from the back of pusher tray assembly 100 to the front of pusher tray assembly 100. As depicted, pusher tray assembly 100 comprises hanging tray 200, sliding tray 300, and pusher 400.

Hanging tray 200 has tray 210 removably engaged to product display 10 by bracket 260. Hanging tray 200 has adjustable baffles 250 for preventing downward migration of refrigerated air. In an embodiment, left baffle 252 and right baffle 254 may be moveably engaged to tray 210. Left baffle 252 may have left baffle tracks 253 that engage rivets 290 in tray 210. Right baffle 254 may have right baffle tracks 255 that engage rivets 290 in tray 210. Rivets 290 may be rivets 290 in FIG. 6.

Hanging tray has center track 220, left track 230, and right track 240. In an embodiment, center track 220, left track 230, and right track 240 may be longitudinal apertures in tray 210. Center track 220 may be configured to receive fins of pusher 400 such as left fin 450 and right fin 460. Left track 230 and right track 240 may be configured to receive locks of sliding tray 300 and fins of pusher 400 such as left lock 362 of sliding tray 300 and right lock 368 of sliding tray 300. Sliding tray 300 may be slidingly engaged to hanging tray 200 by locks of sliding tray 300 such as left lock 362 and right lock 368, and fins of pusher 400 such as left fin 450, and right fin 460, respectively.

Tray 210 of hanging tray 200 may have lock receptacles such as first left lock receptacle 232 of left track 230 and second left lock receptacle 234 of left track 230. Tray 210 of hanging tray 200 may have first right lock receptacle 242 and second right lock receptacle 244 of right tray track 240.

Sliding tray 300 may have dividers removably affixed such as left divider 330 and right divider 320. Sliding tray may have wire track 310. Wire track 310 may have a number of wires such as first wire 312, second wire 314, third wire 316, and fourth wire 318 removably affixed to wire track 310 by end cap 340 and front plate 350. Left divider 330 may have left divider wire 322 and left divider wall 338. Right divider 320 may have right divider wire 322 and right divider wall 328. In an advantageous embodiment, left divider 330 and right divider 320 may cooperate to be adjustable to a number of widths to accept product of varying sizes.

Pusher 400 engages tray 210 of hanging tray 200 by sliding engagement of left hook 444 with first wire 312 and right hook 448 with fourth wire 318. Pusher 400 has compartment 470 formed by floor 420, plate 410, a portion of left fin 450 extending above floor 420 and a portion of right fin 460 extending above floor 420. Spring 500 has coil 510, band 520, and hook 530. Compartment 470 may contain coil 510. Coil 510 may connected to aperture 374 in sliding tray by hook 530. Left fin 450 and right fin 460 of pusher 400 may slidingly engage center track 220 of tray 210. In an advantageous embodiment, spring 500 may be replaced without a need to disassemble any or all of pusher tray assembly 100 by placing coil 510 in compartment 470, running band beneath pusher 400 and engaging hook 530 to aperture 374 of sliding tray 300. In an advantageous embodiment, pusher plate 400 is held to a rear position, while placing product between pusher plate 410 and a front of display 10, by left lock 362 engaging first left lock receptacle 232 and right 368 lock engaging first right lock receptacle 242 as further described at least in FIG. 15 through FIG. 18.

Figure 2:
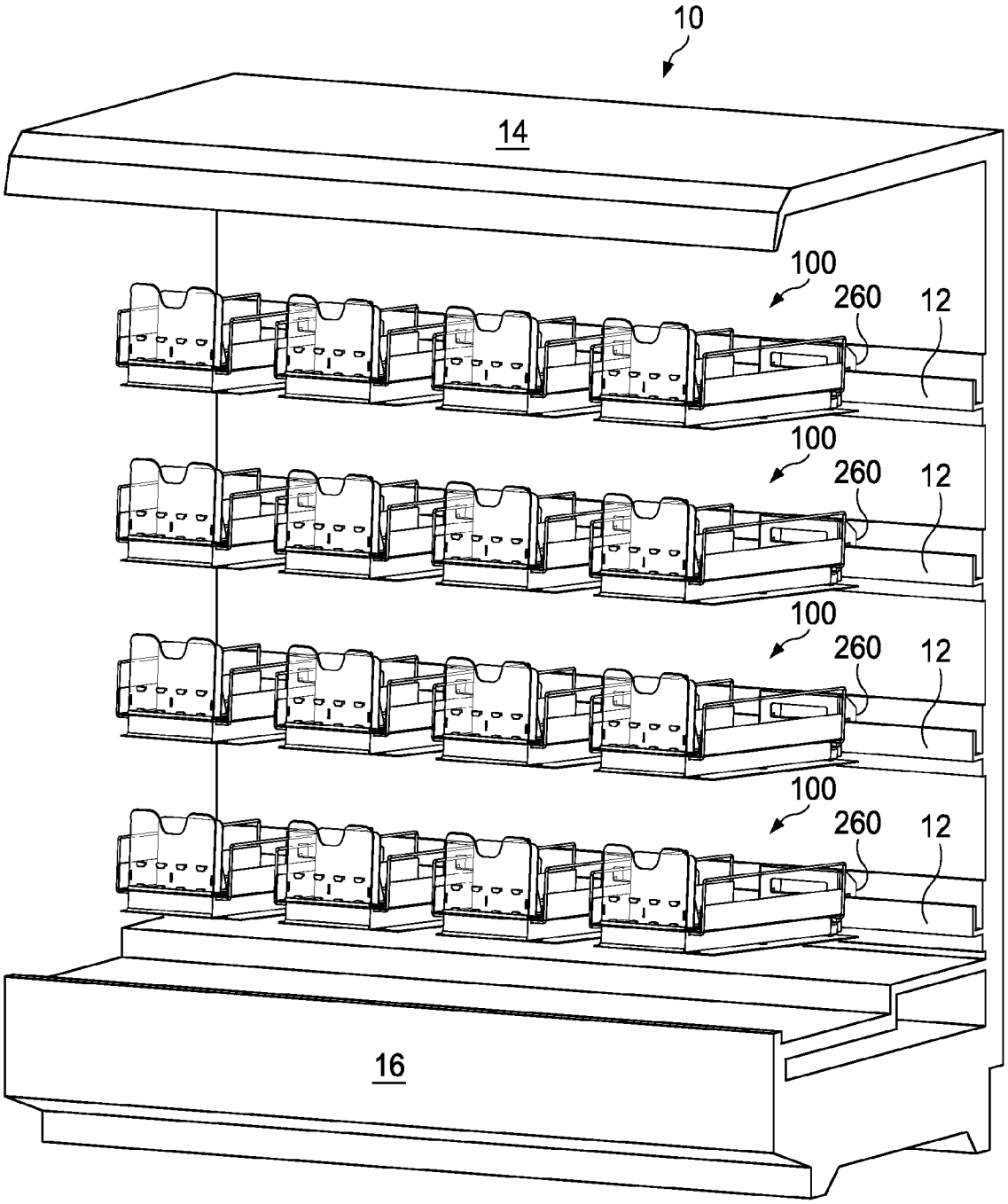
FIG. 2 is an illustration of a product display in accordance with an illustrative embodiment.

Turning to FIG. 2, a product display in accordance with an illustrative embodiment is depicted. Product display 10 may be product display 10 in FIG. 1. In an embodiment, product display 10 may be configured to display a number of different products. In an embodiment, a product may be bags of salad presented for sale to consumers. In another embodiment, the number of different product may comprise a number of vegetables and garden products presented for sale to consumers. Persons skilled in the art recognize and take into account that a number of different products may be displayed in a product display such as product display 10. Product display 10 may have roof 14 and base 16. In one illustrative embodiment product display 10 may be open between roof 14 and base 16. In another illustrative embodiment, product display 10 may be enclosed between roof 14 and base 16 (enclosure not shown). In a further illustrative embodiment, product display area 10 may be refrigerated. Product display 10 may be configured to receive a number of pusher tray assemblies such as pusher tray assembly 100. Pusher tray assembly 100 engages trough 12 of product display 10 via bracket 260 such as bracket 260 in FIG. 1, FIG. 7, and FIG. 8. A number of pusher tray assemblies that may be attached to product display 10 may be determined by dimensions of product display 10 and length of trough 12.

Figure 3:
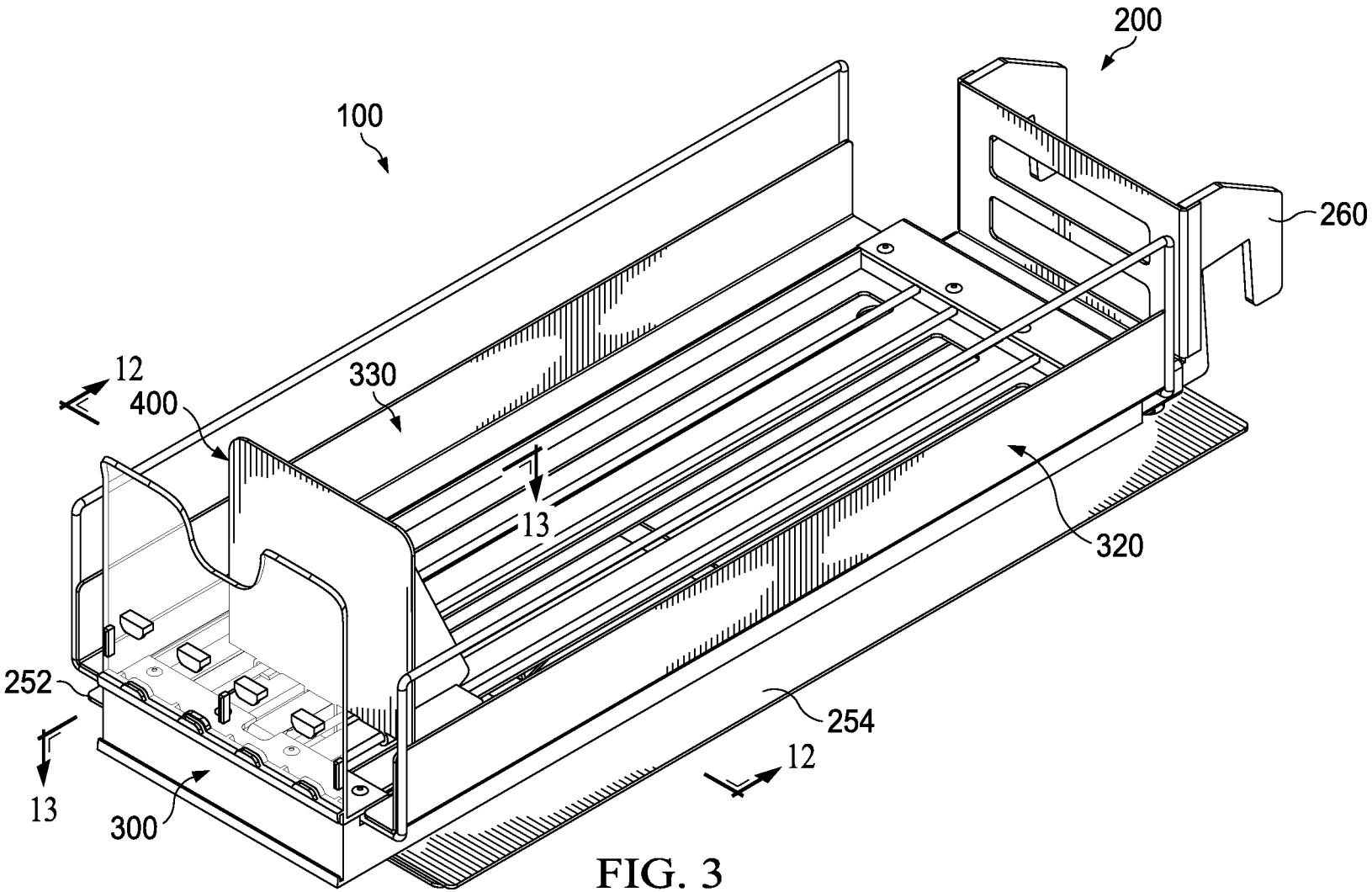
FIG. 3 is an illustration of a pusher tray assembly in accordance with an illustrative embodiment.

Turning to FIG. 3 a pusher tray assembly 100 is depicted in accordance with an illustrative embodiment. Pusher tray assembly comprises hanging tray 200, sliding tray 300 and pusher 400. Hanging tray 200 may have baffles such as left baffle 352 and right baffle 254. Sliding tray 300 may have dividers such as left divider 330 and right divider 320. Pusher 400 may be movably engaged with sliding tray 300 and hanging tray 200. Detail along cut line 12 may be seen in FIG. 12. Detail along cut line 13 may be seen in FIG. 13 and FIG. 15 through FIG. 18.

Figure 4:
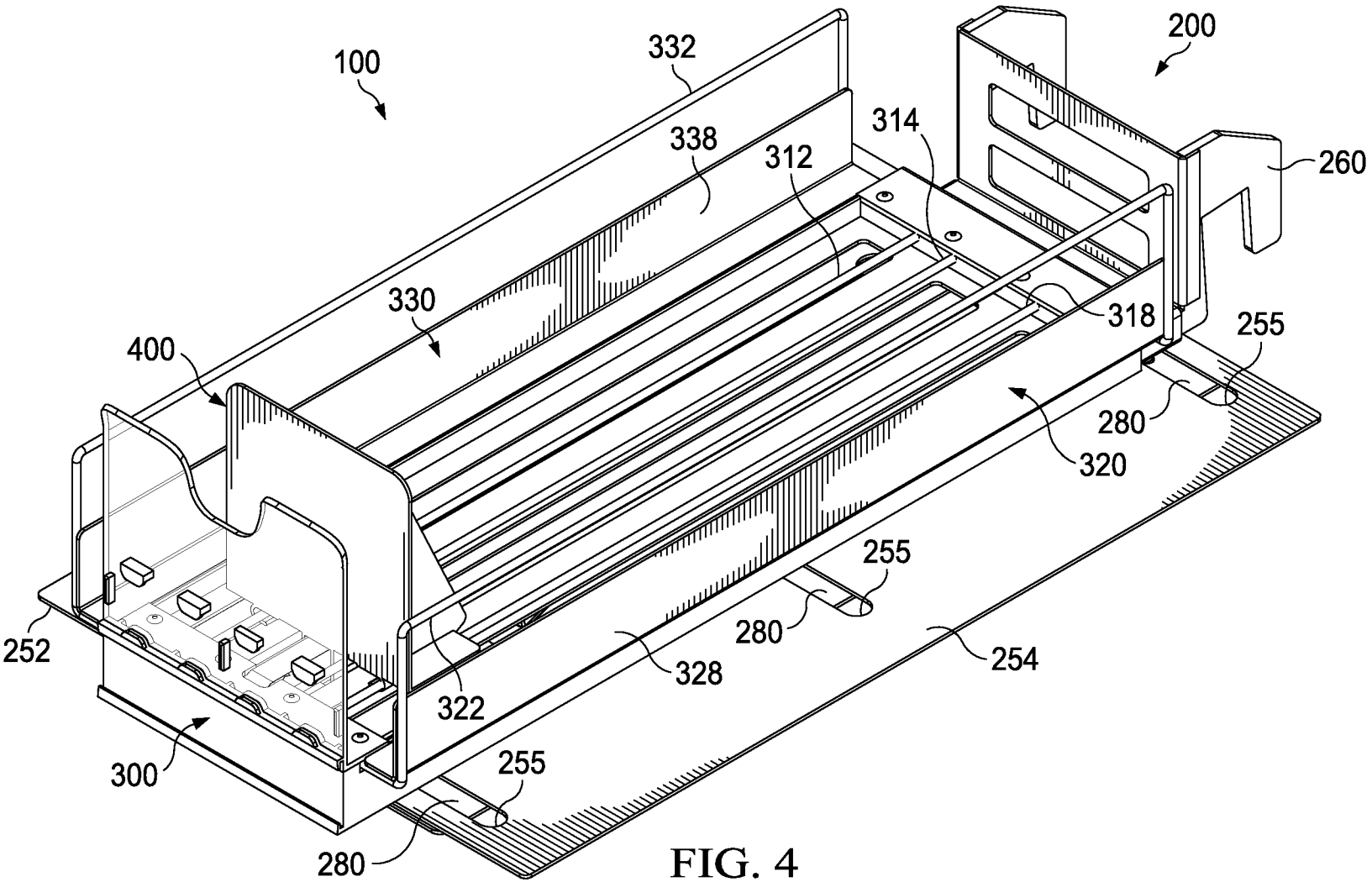
FIG. 4 is an illustration of the pusher tray assembly in accordance with an illustrative embodiment.

Turning to FIG. 4 the pusher tray assembly is depicted in accordance with an illustrative embodiment. Pusher tray assembly 100 may comprise left baffle 252 and right baffle 254 in extended positions to close a gap between one hanging tray 200 and another hanging tray 200 when multiple pusher tray assemblies are employed in a product display such as product display 10 in FIG. 2. Closing a gap between one hanging tray 200 and another hanging tray 200 may form a continuous bottom for a row of pusher tray assemblies 100 in product display 10 to impede a migration of cold air downward in product display 10 when product display 10 is refrigerated. Left divider 330 and right divider 320 may be extended to close a gap between one hanging tray 200 and another hanging tray 200. Left divider 330 and right divider 320 may be left divider 330 and right divider 320 in FIG. 1, and FIG. 3 through FIG. 8.

In an embodiment, right baffle 254 may rest on bottom 280 of hanging tray 200 and slide along bottom 280 guided by right baffle tracks 255. Right baffle tracks may engage bottom 280 of hanging tray 200 by fasteners such as rivets 290 (see FIG. 6). Right baffle 254 may be slidingly engaged to hanging tray 200 by any number of means, methods and/or configurations known to persons skilled in the art so that right baffle 254 may be extended outward from hanging tray 200 of pusher tray assembly 100 to close gaps that may be formed between one pusher tray assembly 100 and another pusher tray assembly 100 when a number of pusher tray assemblies are arrayed in a product display such as product display 10 in FIG. 2. Left baffle 252 functions in like manner to the above described right baffle 254 sliding along bottom 280 guided by left baffle tracks 253 (see FIG. 6). Left baffle 252 mirrors operation of right baffle 254 so that left baffle 252 may be extended outward from hanging tray assembly 200 of pusher tray assembly 100.

Figure 5:
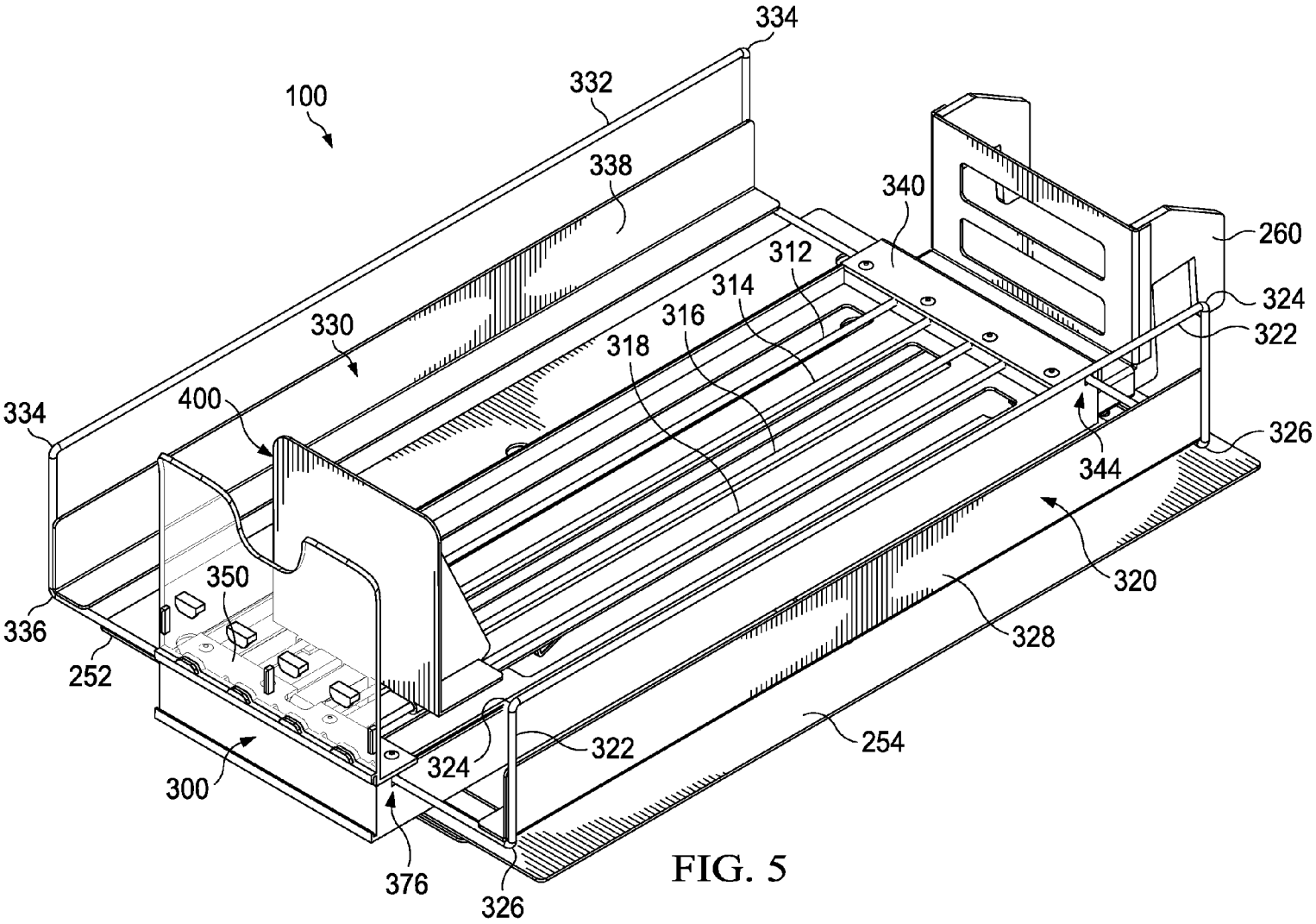
FIG. 5 is an illustration of the pusher tray assembly in accordance with an illustrative embodiment.

Turning to FIG. 5, an illustration of the pusher tray assembly is depicted in accordance with an illustrative embodiment. Pusher tray assembly 100 is shown with left divider 330 and right divider 320 extended. Right divider 320 may comprise right divider wire 322 with right divider wall 328 secured to right divider wire 322. Right divider wire 322 may have a number of right divider first angles 324 and right divider second angles 326. Right divider wall 328 may be formed in an "L" shape. Alternatively, right divider wall may be formed of a first part and a second part joined at approximately a 90 degree angle (not shown). In an embodiment, right divider wall is configured to be affixed to right divider wire 322 below right divider first angles 324 and to engage right divider second angles 326 as right divider wire 322 turns a direction of right divider wire 322 toward sliding tray assembly 300 for insertion into end channel 344 and front channel 376.

Left divider 330 may comprise left divider wire 332 with left divider wall 338 secured to left divider wire 332. Left divider wire 332 may have a number of left divider first angles 334 and left divider second angles 336. Left divider wall 338 may be formed in an "L" shape. Alternatively, left divider wall may be formed as a first part and a second part joined at approximately a 90 degree angle (not shown). In an embodiment, left divider wall is configured to be affixed to left divider wire 332 below left divider first angles 334 and to engage left divider second angles 336 as left divider wire 322 turns a direction of left divider wire 322 toward sliding tray assembly 300 for insertion into end channel 344 and front channel 376. Right divider 320 and left divider 330 are each separately moveable and adjustable in end channel 344 and front channel 376. Right divider 320 and left divider 330 may be slidingly secured in end channel 344 by end cap 340. Right divider 320 and left divider 330 may be slidingly secured in front channel 376 by front plate 350.

Figure 6:
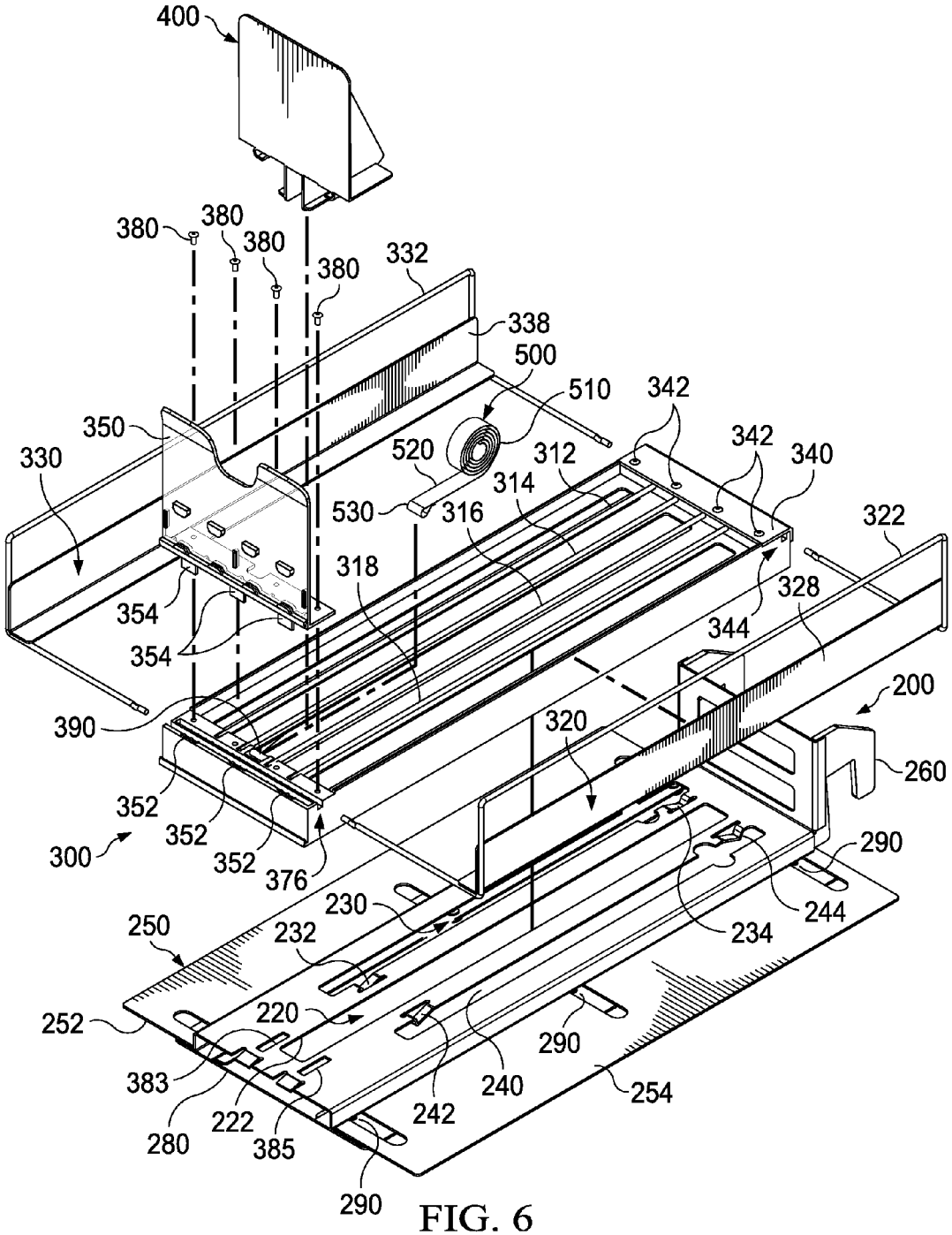
FIG. 6 is an illustration of an exploded view of the pusher tray assembly in accordance with an illustrative embodiment.

Turning to FIG. 6, an illustration of an exploded view of the pusher tray assembly is depicted in accordance with an illustrative embodiment. Pusher tray assembly 100 is shown with hanging tray 200 separated from sliding tray 300. Left baffle 252 and right baffle 254 are shown extended outward from hanging tray 200. Left divider 330 and right divider 320 are shown separated from sliding tray 300. Wire track 310 comprises first wire 312, second wire 314, third wire 316, and fourth wire 318.

End cap 340 and front plate 350 secure first wire 312, second wire 314, third wire 316, and fourth wire 318 to sliding tray. Sliding tray 300 may have one or more front plate apertures 352 for receiving front plate fins 354 of front plate 350. Persons skilled in the art recognize and take into account that any number of front plate flange apertures 352 and any number of front plate flange fins 354 may be provided. In an embodiment, Front plate 350 may be formed from a translucent material such as, for example, clear plastic. Front plate 350 provides a stop for product packages pressed forward by pusher 400. Pusher 400 may press product packages forward by force generated by coil 510 of spring 510 as coil 510 winds up band 510. Fasteners 380 may affix front plate to sliding tray 300. Fasteners 342 may affix end cap to sliding tray 300.

Figure 7:
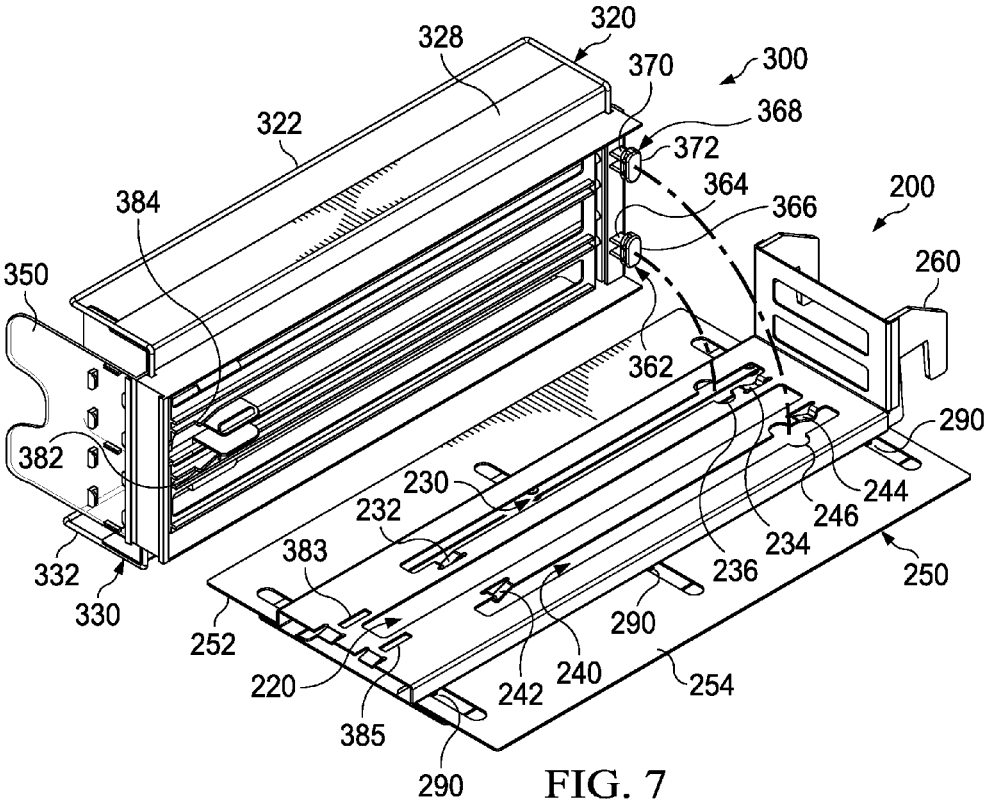
FIG. 7 is an illustration of an exploded view depicting engagement of the sliding tray with the hanging tray to form the pusher tray assembly in accordance with an illustrative embodiment.

Turning to FIG. 7, an illustration of an exploded view depicts engagement of the sliding tray with the hanging tray to form the pusher tray assembly in accordance with an illustrative embodiment. Sliding tray 300 may be slidingly engaged with left tray track 230 of hanging tray 200 by passing left lock 362 through left opening 236 in left tray track 230 so that left post 364 may travel in left tray track 230 while left flange 366 prevents sliding tray 300 from rotating upward beyond left flange 366 when sliding tray 300 is moved from a first position at a rear of hanging tray 200 to a second position in a front of hanging tray 200.

Likewise, sliding tray 300 may be slidingly engaged with right tray track 240 of hanging tray 200 by passing right lock 368 through right opening 246 in right tray track 240 so that right post 370 may travel in right tray track 240 while right flange 372 prevents sliding tray 300 from rotating upward beyond right flange 372 when sliding tray 300 is moved from the first position at a rear of hanging tray 200 to the second position at the front of hanging tray 200.

Left flange 366 may engage second left lock receptacle 234 when sliding tray 300 is in a rear position at a rear of hanging tray 200 and may pass beyond first left lock receptacle 232 when sliding tray 300 is at a front position at a front of hanging tray 200. Right flange 372 may engage second right lock receptacle 244 when sliding tray 300 is in the rear position at the rear of hanging tray 200 and may pass beyond first right lock receptacle 242 when sliding tray 300 is at the front position at a front of hanging tray 200.

Figure 18:
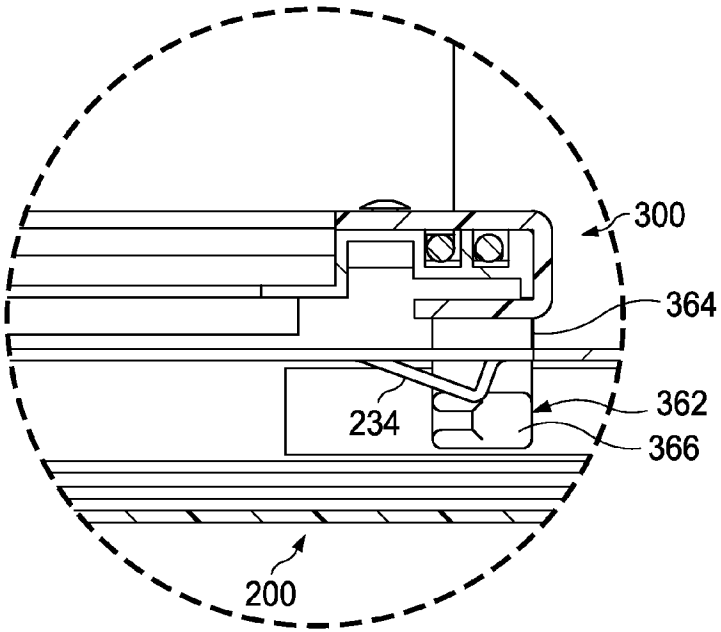
FIG. 18 is an illustration of a detail view of left lock engaging second left lock receptacle when pusher tray assembly is in the closed position.

In an embodiment, left flange 366 and right flange 372 may be engaged by being pressed downward by second left lock receptacle 234 and second right lock receptacle 244, respectively (see detail of left flange 366 and second left lock receptacle 234 in FIG. 18). When sliding tray 300 is locked in the rear position left stop 382 engages left stop receptacle 383 and right stop 384 engages right stop receptacle 385. Left stop 382 and right stop 384 may be disengaged from left stop receptacle 383 and right stop receptacle 395 respectively by lifting sliding tray upward.

When sliding tray 300 is in the front position, sliding tray is cantilevered out from hanging tray 200 and rotated slightly downward by a weight of sliding tray 300. While rotated slightly downward, right flange 372 prevents rearward movement of sliding tray 300 beyond first right lock receptacle 242 (see detail in FIG. 16). Likewise, when sliding tray 300 is cantilevered out from hanging tray 200 and rotated slightly downward by the weight of sliding tray 300, left flange 366 prevents rearward movement of sliding tray 300 beyond first left lock receptacle 232. A user may lift and rotate sliding tray 300 upward to allow passage of right flange 372 past first right lock receptacle 242 and left flange 366 past first left lock receptacle 232.

Figure 8:
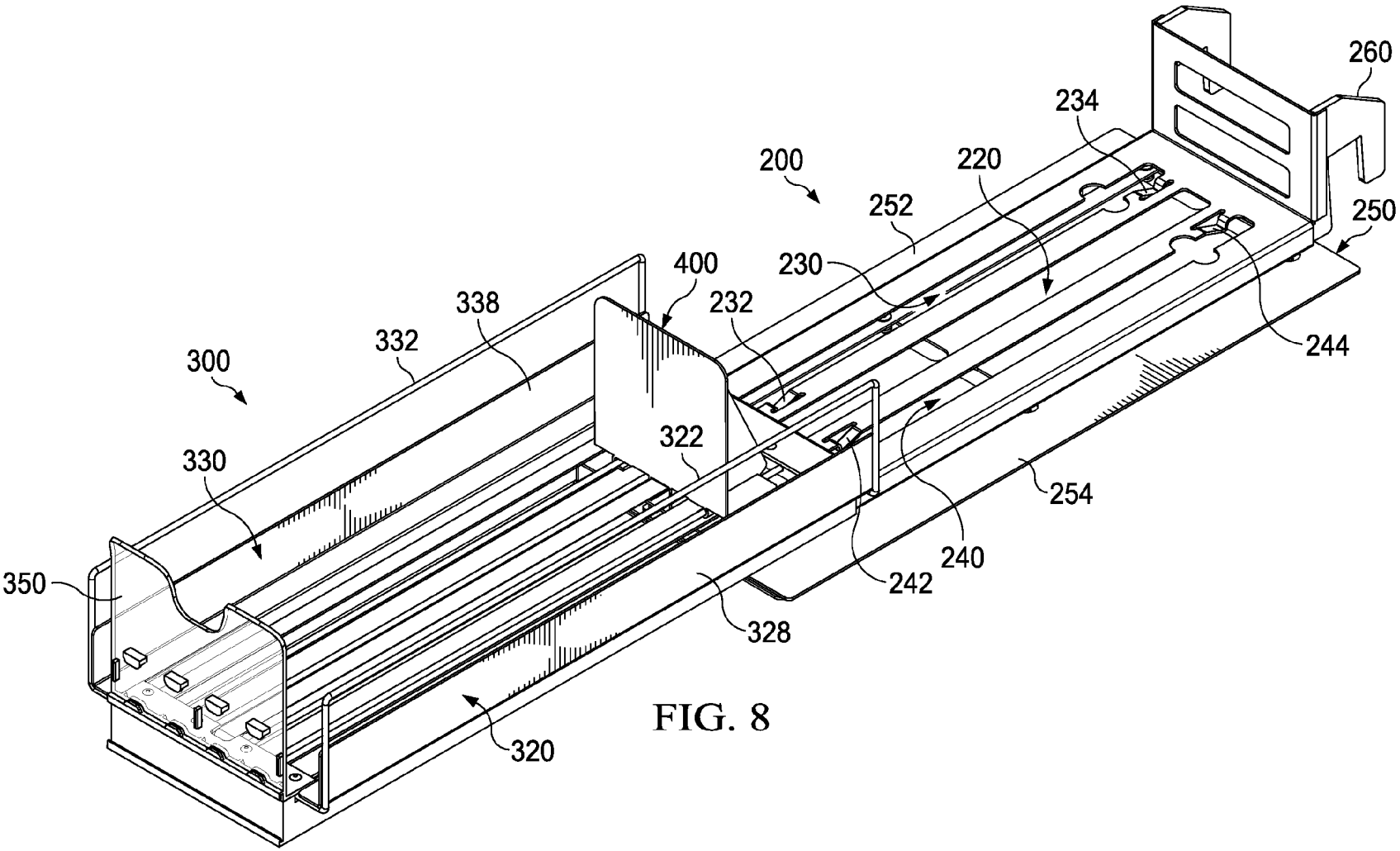
FIG. 8 is an illustration of a right front perspective view of the pusher tray assembly with the sliding tray fully extended.
Figure 15:
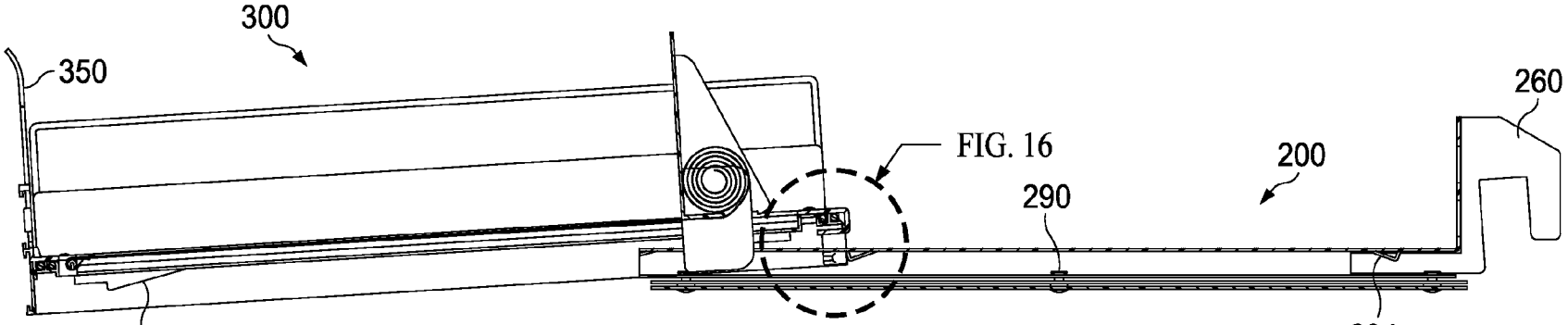
FIG. 15 is an illustration of a view along cut line 13 in FIG. 3 of the pusher tray assembly in an open position.
Figure 16:
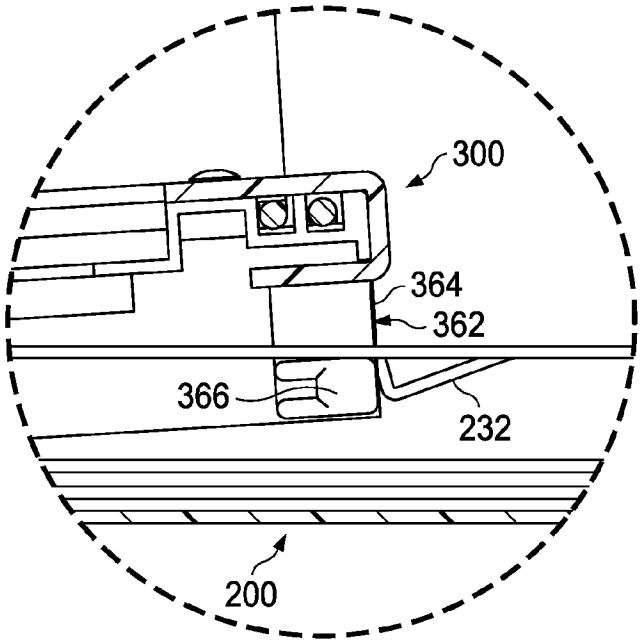
FIG. 16 is an illustration of a detail view of left lock with first left lock receptacle when pusher tray assembly is in an open position.

Turning to FIG. 8, an illustration of a right front perspective view of the pusher tray assembly with the sliding tray fully extended is depicted. Sliding tray 300 may be pulled in a forward direction away from hanging tray 200. Such movement of sliding tray 300 may be performed in order to load product (not shown) into sliding tray 300. For example, pusher tray assembly 100 may be empty with no product inserted between pusher 400 and front plate 350. Pusher 400 may be pulled forward by spring 500 (see FIG. 13 and FIG. 14) until Pusher 400 is stopped by left fin 450 and right fin 460 contacting a front of edge 222 of center track 220 in a position in close proximity to front plate 350 as shown in FIG. 3 through FIG. 5. FIGS. 15-16 further illustrate operation of left lock 362 and right lock 368 to lock sliding tray 300 in the position in close proximity to front plate 350.

As sliding tray 300 is pulled forward and away from hanging tray 200, left fin 450 and right fin 460 of pusher 400 press against front 222 of center tray track in hanging tray 200 so that pusher 400 remains in position relative to hanging tray 200 but moves to the rear of sliding tray 300 as sliding tray 300 is pulled forward. In the configuration depicted in FIG. 8, pusher tray assembly 100 is ready to have product loaded into sliding tray 300 between pusher 400 and front plate 350. In the extended position of FIG. 8, sliding tray 300 may be locked by left lock 362 and right lock 368 engaging first left lock receptacle 232 and first right lock receptacle 242, respectively (see FIG. 6, FIG. 17, and FIG. 18).

Figure 9:
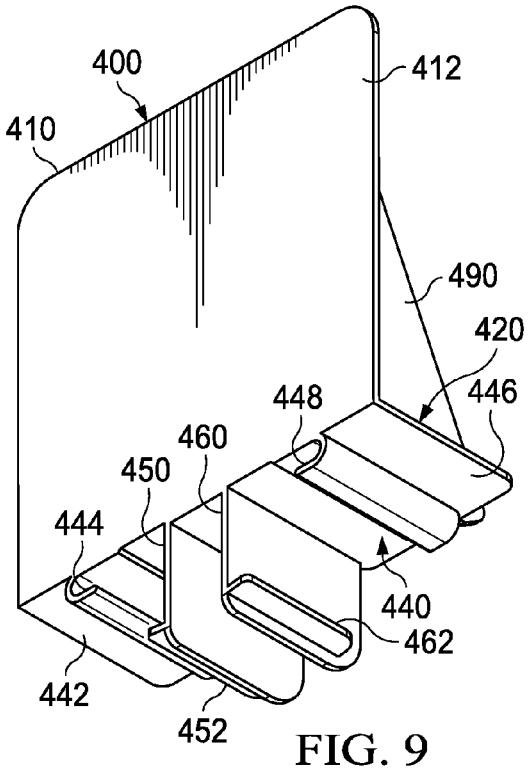
FIG. 9 is an illustration of a right front from below perspective view of a pusher element of the pusher tray assembly in accordance with an illustrative embodiment.

Turning to FIG. 9, an illustration of a right front from below perspective view of a pusher element of the pusher tray assembly is depicted in accordance with an illustrative embodiment. In this view front 412 of plate 410 may be seen with floor 420 extending rearward at approximately a 90 degree angle. Floor 420 may have floor bottom 440 from which left hook 444 and right hook 448 extend downward. Left hook 444 is shown having a curved portion that begins at floor 420 and extends downward to form a semi-circle from which a flat portion extends inwardly and approximately parallel to floor 420 forming a partially enclosed space into which a wire such as first wire 312 may be enclosed. Right hook 448 is shown having a curved portion that begins at floor 420 and extends downward to form a semi-circle from which a flat portion extends inwardly and approximately parallel to floor 420 forming a partially enclosed space into which a wire such as fourth wire 318 may be enclosed.

Floor 420 may have left fin 450 and right fin 460 extending downward at approximately 90 degree angle to floor bottom 440. Left fin 450 may have left fin flange 452 extending outwardly from left fin 450 at approximately an 83 degree angle. Right fin 460 may have right fin flange 462 extending outwardly from right fin 460 at approximately an 83 degree angle. Sliding tray 300 may be moveably connected to hanging tray 200 by left fin 450 and right fin 460. In an embodiment, a user may manipulate left fin 450 and right fin 460 in order to insert left fin 450 and right fin 460 into center track 220 of hanging tray 200. In an embodiment, left fin 450 and right fin 460 may be made from a material having some plasticity or flexibility and may be bent slightly for insertion through center track 220. In another embodiment, left fin 450 and right fin 460 may be manipulated without flexing left fin 450 or right fin 460. Once right fin flange 462 and left fin flange 452 are positioned below tray 210 of hanging tray 200, pusher 400 may travel guided by center track 220. Movement of pusher 400 out of center track 200 is prevented by right fin flange 462 and left fin flange 452 and sliding tray 300 is moveably connected to hanging tray 200. Once left fin 450 and right fin 460 are moveably engaged with tray 210 of hanging tray 200, left hook 444 may be engaged to a wire such as first wire 312 and right hook 448 may be engaged to a wire such as fourth wire 318. In an embodiment, engagement of left hook 444 and right hook 448 may be performed by manually flexing a wire such a first wire 312 or fourth wire 318 to allow engagement of left hook 444 or right hook 448. In an embodiment, an 83 degree upward angle from vertical of right fin flange 462 and left fin flange 452 facilitates manipulation of right fin 460 and left fin 450 through center track 220 of tray 210. In an embodiment, an 83 degree upward angle from vertical of right fin flange 462 and left fin flange 452 provides additional resistance to pusher 400 being pulled out of center track 220. Persons skilled in the art recognize and take into account that a number of angles may be used in conjunction with right fin flange 462 and left fin flange 452.

Figure 10:
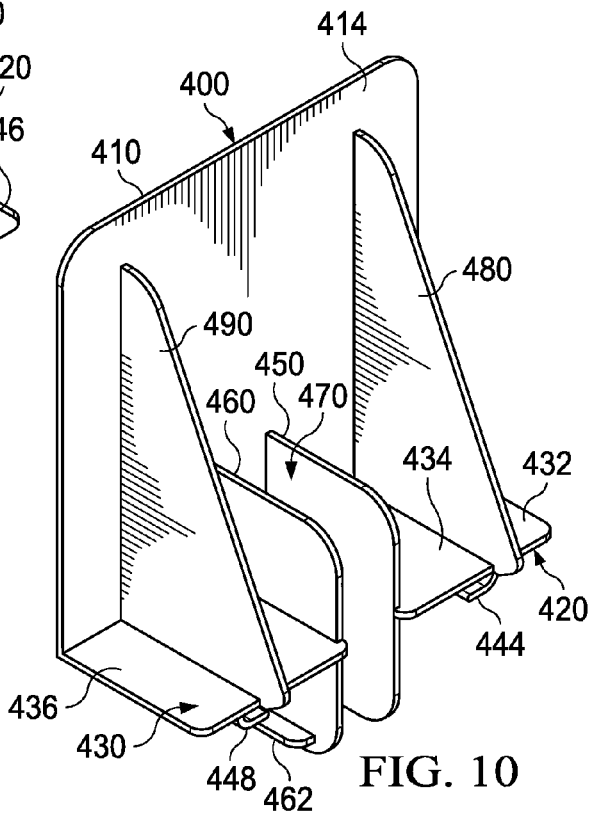
FIG. 10 is a left rear from above perspective view of the pusher of the pusher tray assembly in accordance with an illustrative embodiment.

Turning to FIG. 10, a left rear from above perspective view of the pusher of the pusher tray assembly is depicted in accordance with an illustrative embodiment. Pusher 400 has back 414 of plate 410. Floor 420 has floor top 430. Left brace 480 extends upward from floor top 430 at an approximate 90 degree angle and outward from back 414 at an approximate 90 degree angle. Likewise, right brace 490 extends upward from floor top 430 at an approximate 90 degree angle and outward from back 414 at an approximate 90 degree angle. Left brace 480 and right brace 490 may provide strength and rigidity to plate 410 when front 412 of plate 410 is driving product packages forward along sliding tray 300 (not shown). Left fin 450 and right fin 460 extend upward from floor top 420 at approximately a 90 degree angle to form compartment 470 in pusher 400. Compartment 470 comprises an area formed by back 412 of plate 410, floor center section 432 (see FIG. 13), left fin 450 and right fin 460.

Figure 11:
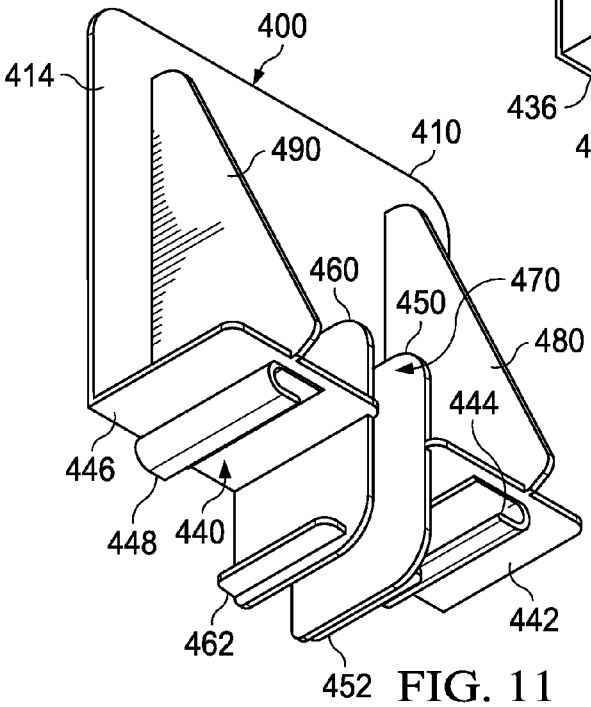
FIG. 11 is a left rear from below perspective view of the pusher of the pusher tray assembly in accordance with an illustrative embodiment.

Turning to FIG. 11, a left rear from below perspective view of the pusher of the pusher tray assembly in accordance with an illustrative embodiment is depicted. Left hook 448 and right hook 444 may be seen from a rear view. Left flange 462 and right flange 452 may be seen from a rear view.

Figure 12:
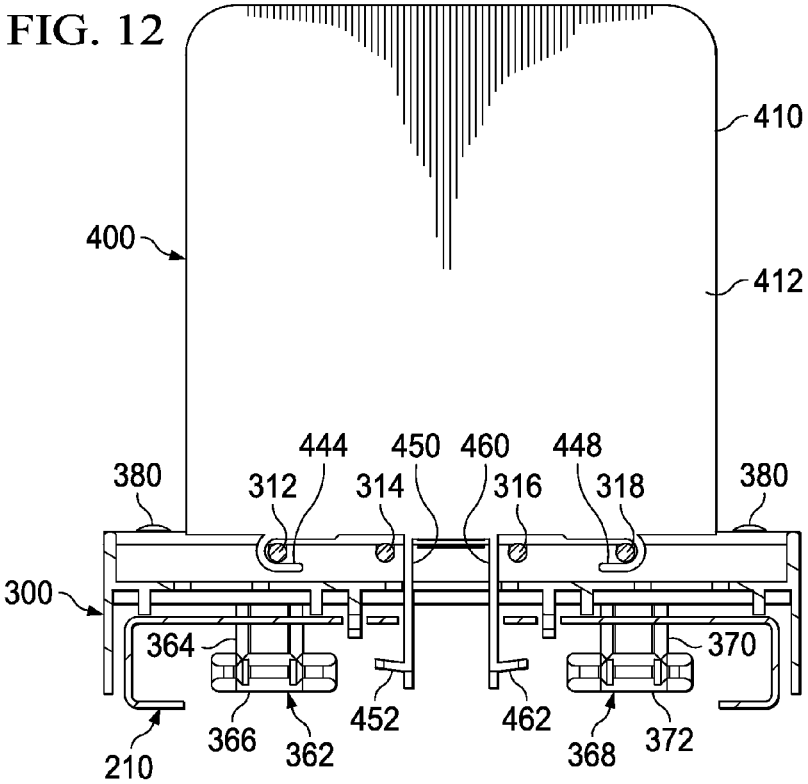
FIG. 12 is an illustration of a view along cut line 12 in FIG. 3 of the pusher tray assembly in accordance with an illustrative embodiment.

Turning to FIG. 12, an illustration of a view along cut line 12 in FIG. 3 of the pusher tray assembly in accordance with an illustrative embodiment is depicted. Pusher plate 400 is shown engaging first wire 312 with left hook 444 and fourth wire 318 with right hook 448. Pusher plate 400 rests on and slides along second wire 314 and third wire 316. Left fin 450 and right fin 460 of pusher 400 extend downward into center tray track 220 of hanging tray 200. Left fin flange 452 and right fin flange 462 of pusher 400 hold sliding tray assembly to tray 210 of hanging tray 200 when left fin flange 452 and right fin flange 462 contact tray 210. Likewise, left flange 366 of left lock 362 and right flange 372 of right lock 368 hold sliding tray assembly to tray 210 of hanging tray 200 when base left flange 366 and base right flange 372 contact tray 210 of hanging tray 200.

Figure 13:
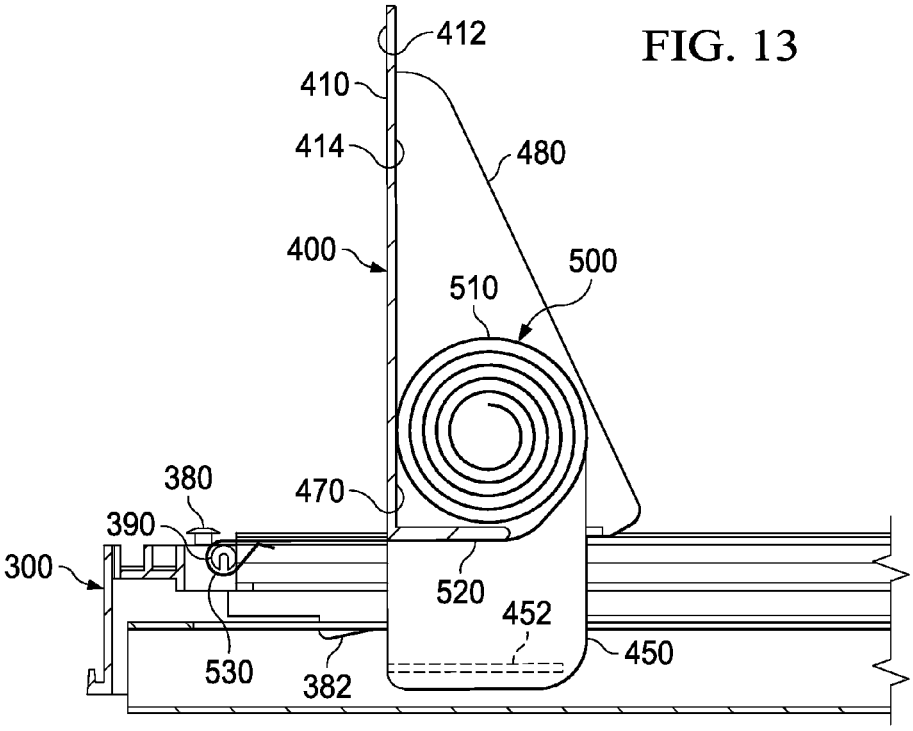
FIG. 13 is an illustration of a view along cut line 13 in FIG. 3 of the pusher tray assembly in accordance with an illustrative embodiment.

Turning to FIG. 13, an illustration of a view along cut line 13 in FIG. 3 of the pusher tray assembly in accordance with an illustrative embodiment is depicted. Spring 500 is shown with coil 510 resting against back 414 of plate 410 of pusher 400. Hook 530 engages post 390 of sliding tray 300. Front plate 350 is configured to allow passage of hook 530 around post so that spring 500 may be removed and replaced without any disassembly of any portions of pusher tray assembly 100. Spring 500 may be removed by disengaging hook 530 from post 390, running band 520 under pusher 400, and removing coil 510 from compartment 470. Spring 500 may be installed by engaging hook 530, running band under pusher 400, and inserting coil 510 in compartment 470.

Figure 14:
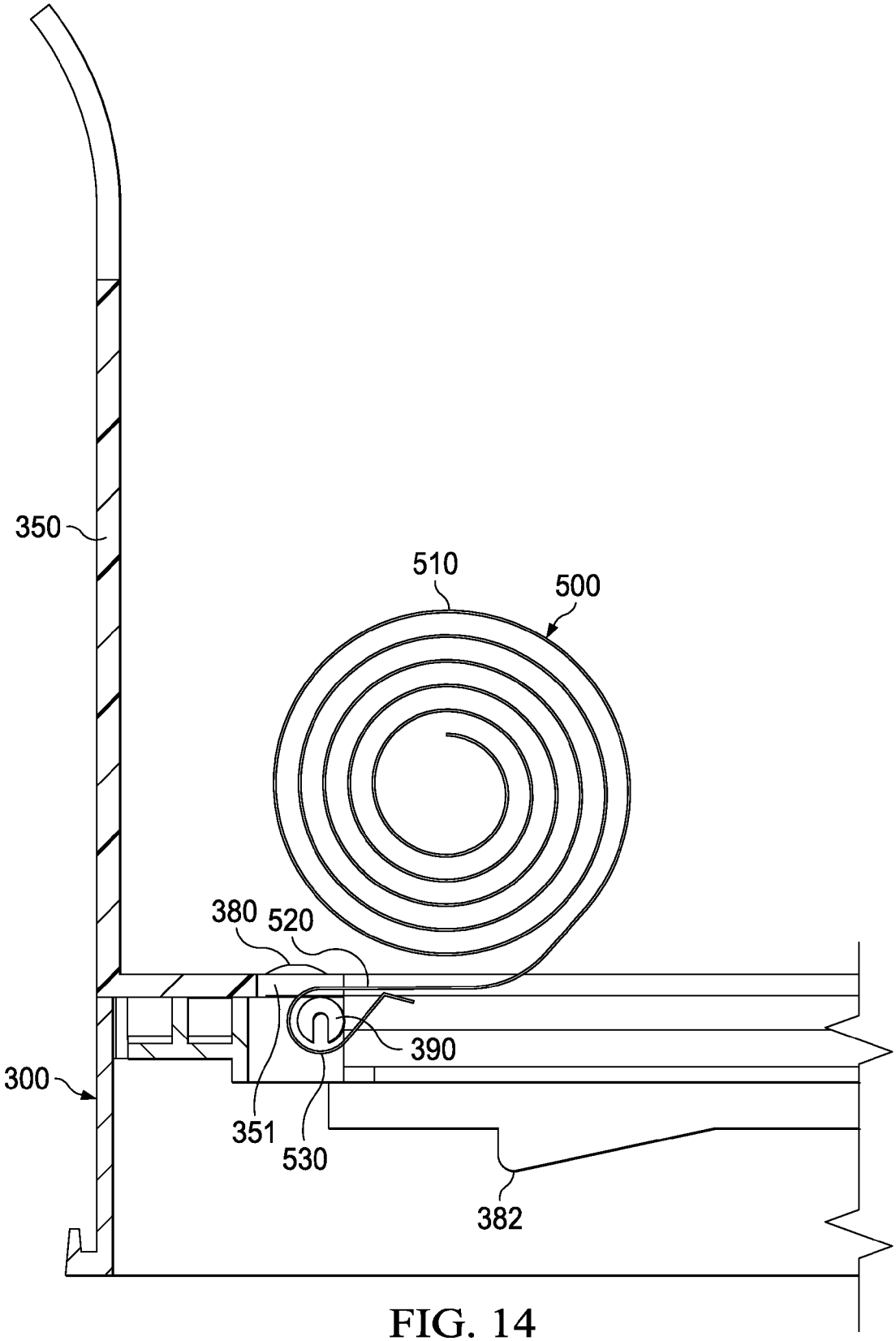
FIG. 14 is an illustration of a view along line cut line 13 in FIG. 3 of the front plate and spring of the pusher tray assembly in accordance with an illustrative embodiment.

Turning to FIG. 14, an illustration of a view along line cut line 13 in FIG. 3 of the front plate and spring of the pusher tray assembly in accordance with an illustrative embodiment is depicted. Hook 530 of spring 500 engages post 390. In the view of FIG. 14, spring is engaged but is not yet positioned in compartment 470 (see FIG. 9 through FIG. 11) for engagement with back 414 of plate 410 of pusher 400. Band 520 may be extended and passed under pusher 400 so that coil 512 may be positioned.

Turning to FIG. 15, an illustration of a view along cut line 13 in FIG. 3 of the pusher tray assembly in an open position is depicted. The position of sliding tray 300 to hanging tray 200 in FIG. 15 corresponds to the position of sliding tray 300 to hanging tray 200 in FIG. 8. Left lock 362 engages first left lock receptacle 232. In an embodiment, when sliding tray 200 is locked by left lock 362 and right lock 368 engaging first left lock receptacle 232 and first right lock receptacle 242, respectively, sliding tray 300 hangs at an angle relative to hanging tray 200. The angle is formed by left post 364 of left lock 362 and right post 370 of right lock 368, respectively. Further, a weight of sliding tray 300 causes sliding tray 300 to rotate downward to a cantilevered position over hanging tray 200 and may be stopped at least in part by left flange 366 of left lock 362 and right flange 372 of right lock 368. A user may unlock sliding tray 200 from the position described above by rotating sliding tray 200 upward to a plane parallel to or above a plane of hanging tray 200 and pushing sliding tray 300 toward bracket 260 of hanging tray 200.

Turning to FIG. 16, an illustration of a detail view of left lock with first left lock receptacle when pusher tray assembly is in an open position is depicted. Left lock 362 may be seen engaged with left lock receptacle 232. When sliding tray 200 is rotated upward, left flange 366 will move downward on left post to a position below left lock receptacle 232. Once left flange 366 moves to a position below left lock receptacle 232, sliding tray 300 may be moved toward bracket 260 of hanging tray 200.

Figure 17:
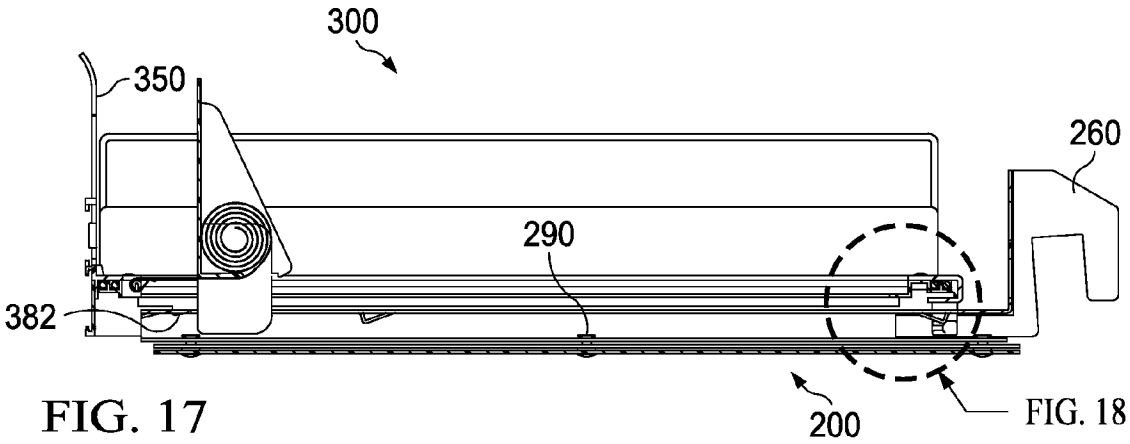
FIG. 17 is an illustration of a view along cut line 13 in FIG. 3 of the pusher tray assembly in a closed position.

Turning to FIG. 17, an illustration of a view along cut line 13 in FIG. 3 of the pusher tray assembly in a closed position is depicted. In an embodiment depicted in FIG. 17, sliding tray 300 has been moved back toward bracket 260 of hanging tray 200 until left lock 362 engages second left lock receptacle 234 and right lock 368 (see FIG. 7) engages second right lock receptacle 244 (see FIG. 7). Right lock 368 engages second right lock receptacle 244 in a similar manner to an engagement of left lock 362 and second left lock receptacle 234.

FIG. 18 is an illustration of a detail view of left lock engaging second left lock receptacle when pusher tray assembly is in the closed position. Left flange 366 at end of left post 364 of left lock 362 is pressed downward by second left lock receptacle keeping sliding tray 200 in a plane substantially parallel to a plane of hanging tray 300. A user may unlock sliding tray 300 from hanging tray 200 by lifting up and rotating sliding tray 300 in substantially vertical direction. Lifting up and rotating sliding tray 300 in a substantially vertical direction releases left flange 366 from second left lock receptacle. Likewise lifting up and rotating sliding tray 300 in substantially vertical direction releases right lock 368 from second right lock receptacle 244 (see FIG. 7). Movement of right lock 368 to release from second right lock receptacle 244, mirrors the movement of left lock 362 to release from second left lock receptacle 234.

In an illustrative embodiment, a pusher tray assembly comprises a hanging tray and a sliding tray having a wire track, the sliding tray moveably connected to the hanging tray by fins of a pusher, the pusher slidingly engaged to the wire track for movement between a first position and a second position.

In an illustrative embodiment, a first hook may extend from a bottom of the pusher and slidingly engage a first wire in the wire track. A second hook may extend from the bottom of the pusher and slidingly engage a second wire in the wire track.

In an illustrative embodiment, the wire track may comprise a number of wires, each wire having a flexibility to allow a lateral movement for engagement with the first hook and the second hook.

In an illustrative embodiment, at least one fin of the pusher may slidingly engage with a center track in the hanging tray.

In an illustrative embodiment, a left fin may extend downward from a bottom of the pusher and slidingly engage with a first side of a center tray track in the hanging tray.

In an illustrative embodiment, a right fin may extend downward from the bottom of the pusher and slidingly engage with a second side of the center tray track in the hanging tray.

In an illustrative embodiment, each wire may have a first end removably engaged to a front end of the sliding tray by a front plate and a second end removably engaged to a rear end of the sliding tray by an end cap.

In an illustrative embodiment, one or more dividers may be removably engaged to the sliding tray.

In an illustrative embodiment, a compartment may be formed by a back of a plate, a right brace, a left brace, and a center section of a floor, the compartment configured to receive a coil of the spring and to pass a running end of the spring under the center section of the floor.

In an illustrative embodiment, the spring may further comprise a spring hook removably engaged to a spring aperture in a base of the sliding tray.

In an illustrative embodiment, one or more front plate fins may engage one or more front plate apertures in a base of the sliding tray.

In an illustrative embodiment, a lock may be on a bottom of the sliding tray and a lock aperture may be in the hanging tray for receiving the lock when the sliding tray has moved into a locking position.

In an illustrative embodiment, a left baffle and a right baffle may each be slidingly engaged to the hanging tray and moveable from a first position to a second position that extends a longitudinal footprint of the hanging tray to each side.

In an illustrative embodiment, the second position of the left baffle and the right baffle may impede a flow of air in a vertical direction when the hanging tray is installed in a product display.

In an illustrative embodiment, a bracket at a rear end of the hanging tray may be configured to removably engage a product display. A product display may include a wall of a refrigeration unit.

In an illustrative embodiment, a coil of the spring may reside in a compartment of the pusher and a spring hook of the spring may removably engage a spring aperture in a base of the sliding tray.

In an illustrative embodiment, a wire track in the sliding tray may have a plurality of wires, each wire having a first end removably engaged to a front end of the sliding tray by a front plate and a second end removably engaged to a rear end of the sliding tray by an end cap.

In an illustrative embodiment, a pusher may be slidingly engaged to the sliding tray and to the hanging tray for movement between a rear of the sliding tray and a front of the sliding tray and for slidingly engaging the sliding tray to the hanging tray.

In an illustrative embodiment, a left hook may extend from a bottom of the pusher and slidingly engage a first wire in the wire track. A right hook may extend from the bottom of the pusher and slidingly engage a second wire in the wire track. A left fin may extend downward from a bottom of the pusher and slidingly engage a center tray track in the hanging tray. A right fin may extend downward from the bottom of the pusher and engage the center tray track in the hanging tray.

In an illustrative embodiment, a back of a plate of the pusher, a right brace of the pusher, a left brace of the pusher, and a center section of a floor of the pusher may form a compartment configured to receive a coil of the spring and to pass a band of the spring under the center section of the floor. The running end may be a band located between a hook and a coil.

In an illustrative embodiment, the spring may further comprises a spring hook removably engaged to a spring aperture in a base of the sliding tray. In an embodiment, the spring hook may be removably engaged by a hook of the spring engaging a post in the sliding tray. In an embodiment, the front plate may provide an access to the post so that the spring hook may be engaged without removing the front plate.

In an illustrative embodiment, one or more front plate fins may engage one or more front plate apertures in a base of the sliding tray.

In an illustrative embodiment, a lock aperture in the hanging tray may receive the lock when the sliding tray has moved into a locking position.

In an illustrative embodiment, a left baffle and a right baffle, each slidingly engaged to the hanging tray and moveable from a first position to a second position may extend a longitudinal footprint of the hanging tray to each side.

In an illustrative embodiment, a second position of the left baffle and the right baffle may impede a flow of air in a vertical direction when the hanging tray is installed in a display unit.

In an illustrative embodiment, a bracket at a rear end of the hanging tray may be configured to removably engage a product display. In an embodiment, the bracket may be configured to engage a trough in the product display.

In an illustrative embodiment, a pusher tray assembly may be constructed to secure a sliding try to a hanging tray by engaging hooks on a pusher with wires on the sliding tray and by slidingly engaging fins on the pusher with a center track on the hanging tray so that flanges on the fins prevent separation of the sliding tray from the hanging tray.

In an illustrative embodiment, movable dividers may extend a bottom of the hanging tray by moving baffles outward from a bottom of the hanging tray, the baffles slidingly engaged to the bottom.

When one component is "associated" with another component, the association is a physical association in these depicted examples. For example, a first component, tray 118, may be considered to be associated with a second component, base 120, by being secured to the second component, bonded to the second component, mounted to the second component, welded to the second component, fastened to the second component, and/or connected to the second component in some other suitable manner. The first component also may be connected to the second component using a third component. The first component may also be considered to be associated with the second component by being formed as part of and/or an extension of the second component.

Thus, the illustrative embodiments provide an apparatus for storing products. Further, the illustrative embodiments also may be used to maintain the presence of products at the front of a product display.

The illustrative embodiments provide an apparatus that allows for a reduction in the amount of jostling of shelved products. The illustrative embodiments also provide an apparatus that allows for greater flexibility in placement of dividers. Additionally, the illustrative embodiments provide an apparatus which provides greater structural support. The illustrative embodiments further provide an apparatus that reduces the stress on anchoring points.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A pusher tray assembly comprising:

a hanging tray having a first tray track and a second tray track, a first opening in the first tray track and a second opening in the second tray track;

a sliding tray having a wire track, a first lock having a first post and a first flange, and a second lock having a second post and a second flange, the first lock configured to pass through the first opening and the second lock configured to pass through the second opening, the first post configured to travel in the first tray track and the second post configured to travel in the second tray track such that the sliding tray is moveably connected to the hanging tray, the first flange and the second flange preventing the sliding tray from moving away from the hanging tray when the sliding tray is moved from a first position at a rear of the hanging tray to a second position in a front of the hanging tray; and a pusher slidingly engaged to the wire track for movement between a first position and a second position, the pusher having at least one fin slidingly engaged with a center track in the hanging tray.

2. The pusher tray assembly of claim 1, further comprising:

a first hook extending from a bottom of the pusher slidingly engaged to a first wire in the wire track, and a second hook extending from the bottom of the pusher slidingly engaged to a second wire in the wire track.

3. The pusher tray assembly of claim 2, wherein the wire track comprises a number of wires, each wire having a flexibility to allow a lateral movement for engagement with the first hook and the second hook.

4. The pusher tray assembly of claim 1, said at least one fin further comprising:

a left fin extending downward from a bottom of the pusher slidingly engaged with a first side of a center tray track in the hanging tray;

a right fin extending downward from the bottom of the pusher slidingly engaged with a second side of the center tray track in the hanging tray.

5. The pusher tray assembly of claim 3 wherein each wire has a first end removably engaged to a front end of the sliding tray by a front plate and a second end removably engaged to a rear end of the sliding tray by an end cap.

6. The pusher tray assembly of claim 1, wherein one or more dividers are removably engaged to the sliding tray.

7. The pusher tray assembly of claim 1 wherein the pusher further comprises:

a compartment formed by a back of a plate, a right brace, a left brace, and a center section of a floor, the compartment configured to receive a coil of a spring and to pass a running end of the spring under the center section of the floor.

8. The pusher tray assembly of claim 1, further comprising a spring, wherein the spring further comprises a spring hook removably engaged to a spring aperture in a base of the sliding tray.

9. The pusher tray assembly of claim 1, further comprising: a front plate having one or more front plate fins engaged with one or more front plate apertures in a base of the sliding tray.

10. The pusher tray assembly of claim 1, further comprising:

a left baffle and a right baffle, each slidingly engaged to the hanging tray and moveable from a first position to a second position that extends a longitudinal footprint of the hanging tray to each side.

11. The pusher tray assembly of claim 10, wherein the second position of the left baffle and the right baffle impedes a flow of air in a vertical direction when the hanging tray is installed in a display unit.

12. The pusher tray assembly of claim 1 further comprising:

a bracket at a rear end of the hanging tray configured to removably engage a wall of a refrigeration unit.

13. The pusher tray assembly of claim 1, further comprising a spring, wherein a coil of the spring resides in a compartment of the pusher and a spring hook of the spring removably engages a spring aperture in a base of the sliding tray.

14. A pusher tray assembly comprising:

a hanging tray having a first tray track and a second tray track, a first opening in the first tray track and a second opening in the second tray track;

a sliding tray having a first lock and a second lock, the first lock comprising a first post and a first flange, and the second lock comprising a second post and a second flange, the first lock configured to pass through the first opening and the second lock configured to pass through the second opening, the first post configured to travel in the first tray track and the second post configured to travel in the second tray track such that the sliding tray is moveably connected to the hanging tray, the first flange and the second flange preventing the sliding tray from moving away from the hanging tray when the sliding tray is moved from a first position at a rear of the hanging tray to a second position in a front of the hanging tray;

a wire track in the sliding tray, the wire track having a plurality of wires, each wire having a first end removably engaged to a front end of the sliding tray by a front plate and a second end removably engaged to a rear end of the sliding tray by an end cap;

a pusher slidingly engaged to the sliding tray and to the hanging tray for movement between a rear of the sliding tray and a front of the sliding tray and for slidingly engaging the sliding tray to the hanging tray;

a left hook extending from a bottom of the pusher that slidingly engages a first wire in the wire track;

a right hook extending from the bottom of the pusher that slidingly engages a second wire in the wire track;

a left fin extending downward from a bottom of the pusher that slidingly engages a center tray track in the hanging tray;

a right fin extending downward from the bottom of the pusher that slidingly engages the center tray track in the hanging tray; and a left baffle and a right baffle, each slidingly engaged to the hanging tray and moveable from a first position to a second position that extends a longitudinal footprint of the hanging tray to each side, wherein the second position of the left baffle and the right baffle impedes a flow of air in a vertical direction when the hanging tray is installed in a display unit.

15. The pusher tray assembly of claim 14, further comprising:

the pusher having a plate with a back, a right brace, a left brace, and of a floor with a center section; and a compartment formed by the back of the plate, the right brace, the left brace, and the center section of the floor, the compartment configured to receive a coil of a spring and to pass a running end of the spring under the center section of the floor; and a front plate having one or more front plate fins engaged with one or more front plate apertures in a base of the sliding tray;

wherein the spring further comprises a spring hook removably engaged to a spring aperture in the base of the sliding tray.

16. The pusher tray assembly of claim 14 further comprising:

a bracket at a rear end of the hanging tray configured to removably engage a product display.

* * * * *